US009347653B2

(12) United States Patent
Tadano et al.

(10) Patent No.: US 9,347,653 B2
(45) Date of Patent: May 24, 2016

(54) LIGHT SOURCE DEVICE, ARTIFICIAL SUNLIGHT RADIATION APPARATUS, AND METHOD FOR MAINTAINING LIGHT SOURCE DEVICE

(75) Inventors: Hiroyuki Tadano, Osaka (JP); Kohji Minami, Osaka (JP); Masaru Ogawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 22 days.

(21) Appl. No.: 14/350,142

(22) PCT Filed: May 18, 2012

(86) PCT No.: PCT/JP2012/062863

§ 371 (c)(1),
(2), (4) Date: Apr. 7, 2014

(87) PCT Pub. No.: WO2013/061640

PCT Pub. Date: May 2, 2013

(65) Prior Publication Data

US 2014/0233206 A1 Aug. 21, 2014

(30) Foreign Application Priority Data

Oct. 28, 2011 (JP) ..... 2011-238000

(51) Int. Cl.
*F21S 8/06* (2006.01)
*F21V 17/04* (2006.01)
(Continued)

(52) U.S. Cl.
CPC ..... *F21V 17/04* (2013.01); *F21S 8/006* (2013.01); *F21V 7/08* (2013.01)

(58) Field of Classification Search
CPC ..... H01J 61/08; H01J 61/86; H01J 61/025; H01J 61/30; H01J 61/40; F21S 8/006; F21S 10/005; F21S 8/031; F21V 7/08; F21V 2200/08; F21V 7/09; F21V 2200/17; F21V 9/02; G02B 6/0026; G02B 6/0028; G02B 6/007; G02B 6/006; G02B 6/005; G02B 6/0068; G02B 27/0983; G02B 6/00; G02B 6/0018; G02B 6/4298; F21Y 2101/02; G01J 1/04; G01J 1/0422; G01J 1/0488; G01J 1/08
USPC ..... 362/2, 11, 229–231, 244, 245, 362/261–263, 296.01, 296.06, 299, 308, 362/310, 326–331, 362, 554–556, 560, 583, 362/608–613; 313/110, 112, 113, 562, 634
See application file for complete search history.

(56) References Cited

U.S. PATENT DOCUMENTS 3,639,751 A * 2/1972 Pichel ..... 362/261
3,808,496 A * 4/1974 McRae et al. ..... 313/113
(Continued)

FOREIGN PATENT DOCUMENTS

JP 7-211103 A 8/1995
JP 2002-48704 A 2/2002
JP 4865883 B2 2/2012

OTHER PUBLICATIONS

Advanced Industrial Property Network (AIPN) English Translation of Japanese Patent No. JP 07-211103.*
(Continued)

*Primary Examiner* — Hargobind S Sawhney
(74) *Attorney, Agent, or Firm* — Keating & Bennett, LLP

(57) ABSTRACT

A light source device (10) according to the present invention includes a first light source (1) and a first condensing member (2) that has a first opening (24) and that outputs output light from the first light source (1) through the first opening (24). The first condensing member (2) is constituted of a front condensing member (2*a*) that includes the first opening (24) and a rear condensing member (2*b*) that does not include the first opening (24). The rear condensing member (2*b*) is detachable from the first condensing member (2).

2 Claims, 9 Drawing Sheets

(51) Int. Cl.

| | |
|---|---|
| ***F21S 8/00*** | (2006.01) |
| ***F21V 7/08*** | (2006.01) |

(56) References Cited

U.S. PATENT DOCUMENTS

| | | | | | |
|---|---|---|---|---|---|
| 4,066,887 | A * | 1/1978 | Levis | F21S 8/00 | 353/98 |
| 4,633,128 | A * | 12/1986 | Roberts et al. | 313/113 | |
| 5,285,363 | A * | 2/1994 | Meuse | F21V 9/04 | 126/629 |
| 5,299,279 | A * | 3/1994 | Roberts | 392/421 | |
| 5,399,931 | A * | 3/1995 | Roberts | 313/46 | |
| 5,561,338 | A * | 10/1996 | Roberts et al. | 313/46 | |
| 5,903,088 | A * | 5/1999 | Sugitani et al. | 313/46 | |
| 6,114,807 | A * | 9/2000 | Kavanagh | 313/570 | |
| 6,181,053 | B1 * | 1/2001 | Roberts | 313/46 | |
| 6,297,591 | B1 * | 10/2001 | Roberts | 313/631 | |
| 6,609,816 | B2 * | 8/2003 | Ansari et al. | 362/294 | |
| 6,670,758 | B2 * | 12/2003 | Beech et al. | 313/634 | |
| 6,768,264 | B2 * | 7/2004 | Beech et al. | 313/634 | |
| 7,176,633 | B1 * | 2/2007 | Roberts | 313/634 | |
| 7,306,342 | B2 * | 12/2007 | Wu | H04N 9/315 | 348/E9.027 |
| 7,372,201 | B1 * | 5/2008 | Roberts | 313/558 | |
| 2005/0231955 | A1 * | 10/2005 | Gordin | F21V 9/06 | 362/263 |
| 2013/0033847 | A1 | 2/2013 | Kobayashi et al. | | |

OTHER PUBLICATIONS

Official Communication issued in International Patent Application No. PCT/JP2012/062863, mailed on Jul. 3, 2012.

* cited by examiner

LIGHT SOURCE DEVICE, ARTIFICIAL SUNLIGHT RADIATION APPARATUS, AND METHOD FOR MAINTAINING LIGHT SOURCE DEVICE

TECHNICAL FIELD

The present invention relates to light source devices and artificial sunlight radiation apparatuses equipped with the light source devices.

BACKGROUND ART

The value of solar batteries as clean energy sources has been acknowledged, and the demands therefor are growing. Solar batteries can be used in a wide variety of fields, from power energy sources for large-scale devices to small-sized power sources for precision electronic devices. In order for solar batteries to be widely used in various fields, the properties of the batteries, especially the output characteristics thereof, need to be accurately measured. Otherwise, it is assumed that various problems may occur in the devices using the solar batteries. Therefore, a technology that can radiate high-precision artificial sunlight, which can be used for inspecting, measuring, and testing a solar battery, over a wide area is particularly in demand.

The main element required in artificial sunlight is to make the emission spectrum of the artificial sunlight analogous to that of reference sunlight (established by Japanese Industrial Standard) and also to make the illuminance of the artificial sunlight about the same level as that of reference sunlight. Artificial sunlight radiation apparatuses are being developed as apparatuses that can radiate such artificial sunlight. Normally, such an artificial sunlight radiation apparatus radiates artificial light (artificial sunlight) with uniform illuminance onto a light-receiving surface of a solar battery so as to be used for measuring, for example, the amount of electricity generated in the solar battery.

An artificial sunlight radiation apparatus (solar simulator) discussed in Patent Literature 1 has a structure that returns light output from a lamp to a radiation surface by using a reflective plate and has an optical filter, which is for forming an artificial sunlight spectrum, disposed between a surface where a measured object is set and the reflective plate. In the structure according to this related art, the reflection angle of the reflective plate is set such that the light output toward the reflective plate from the lamp changes direction and travels toward the radiation surface, whereby uniform illuminance is maintained at the radiation surface.

CITATION LIST

Patent Literature

PTL 1: Japanese Unexamined Patent Application Publication No. 2002-48704 (Feb. 15, 2002)

SUMMARY OF INVENTION

Technical Problem

Patent Literature 1 discloses a procedure for measuring and adjusting the illuminance after the lamp has been replaced. However, Patent Literature 1 does not disclose a procedure from a mechanical or structural viewpoint, such as how the lamp is removed from or installed in the artificial sunlight radiation apparatus.

Therefore, in the configuration discussed in Patent Literature 1, when a maintenance process, such as a lamp replacement process, is to be performed, the entire artificial sunlight radiation apparatus needs to be disassembled, which is problematic in terms of an increased scale of process and increased labor. Furthermore, when the entire artificial sunlight radiation apparatus is disassembled, dust or the like may possibly enter the artificial sunlight radiation apparatus. When dust or the like enters the artificial sunlight radiation apparatus, problems may occur, particularly, a decrease in illuminance due to contamination of optical members, such as filters and acrylic boards, a deviation in the optical adjustment state, and so on.

The present invention has been made to solve the aforementioned problems, and an object thereof is to achieve an easily maintainable light source device.

Solution to Problem

In order to solve the aforementioned problems, a light source device according to the present invention includes a light source and an optical member that has an opening, that has the light source disposed therein, and that outputs output light from the light source through the opening. The optical member includes an output member that includes the opening and a non-output member that does not include the opening. At least one component of the non-output member is detachable from the optical member.

According to the above configuration, by removing the at least one component of the non-output member from the optical member, the light source can be removed through an area of the optical member other than the opening. Therefore, for example, in an artificial sunlight radiation apparatus equipped with the light source device, even when it is difficult to remove the light source through the opening due to a light guide member or the like existing in the opening, the light source can be easily removed from the interior of the optical member without having to disassemble the artificial sunlight radiation apparatus. Furthermore, in a case where the light source is replaced, a positional displacement and an optical displacement of the light source relative to the light guide member or the like do not occur.

Consequently, a maintenance process of the light source device can be easily performed.

An artificial sunlight radiation apparatus according to the present invention includes a light source device; a light guide member that receives light output from the light source device; a spectral adjustment member that adjusts a spectrum of light output from the light guide member and outputs artificial sunlight; and a light guide plate that radiates the artificial sunlight output from the spectral adjustment member onto a measured object. The light source device includes the light source device according to the present invention.

According to the above configuration, a maintenance process of, for example, the light source of the light source device can be performed without having to disassemble the artificial sunlight radiation apparatus.

In order to solve the aforementioned problems, a method for maintaining a light source device according to the present invention is provided. The light source device includes a light source and an optical member that has an opening, that has the light source disposed therein, and that outputs output light from the light source through the opening. The optical member includes an output member that includes the opening and a non-output member that does not include the opening. At least one component of the non-output member is detachable from the optical member. The method includes a first removal step for removing the at least one component of the non-output member from the optical member; and a second removal step for removing the light source through an area of the optical member from which the at least one component is removed.

According to the above configuration, the light source can be removed through an area other than the opening in the second removal step. Therefore, for example, in an artificial sunlight radiation apparatus equipped with the light source device, even when it is difficult to remove the light source through the opening due to a light guide member or the like existing in the opening, the light source can be easily removed from the interior of the optical member without having to disassemble the artificial sunlight radiation apparatus. Furthermore, in a case where the light source is replaced, a positional displacement and an optical displacement of the light source relative to the light guide member or the like do not occur.

Consequently, a maintenance process of the light source device can be easily performed.

Advantageous Effects of Invention

Accordingly, the light source device according to the present invention includes a light source and an optical member that has an opening, that has the light source disposed therein, and that outputs output light from the light source through the opening. The optical member includes an output member that includes the opening and a non-output member that does not include the opening. At least one component of the non-output member is detachable from the optical member. Furthermore, a method for maintaining a light source device according to the present invention is provided. The light source device includes a light source and an optical member that has an opening, that has the light source disposed therein, and that outputs output light from the light source through the opening. The optical member includes an output member that includes the opening and a non-output member that does not include the opening. At least one component of the non-output member is detachable from the optical member. The method includes a first removal step for removing the at least one component of the non-output member from the optical member; and a second removal step for removing the light source through an area of the optical member from which the at least one component is removed. Consequently, it is advantageous in that a maintenance process of the light source device can be easily performed.

DESCRIPTION OF EMBODIMENTS

First Embodiment (Outline of Artificial Sunlight Radiation Apparatus)

An embodiment according to the present invention will be described below with reference to FIGS. 1 to 8. First, an artificial sunlight radiation apparatus 100 that radiates artificial sunlight onto a measured object 19 will be described in detail with reference to FIG. 1.

Figure 1:
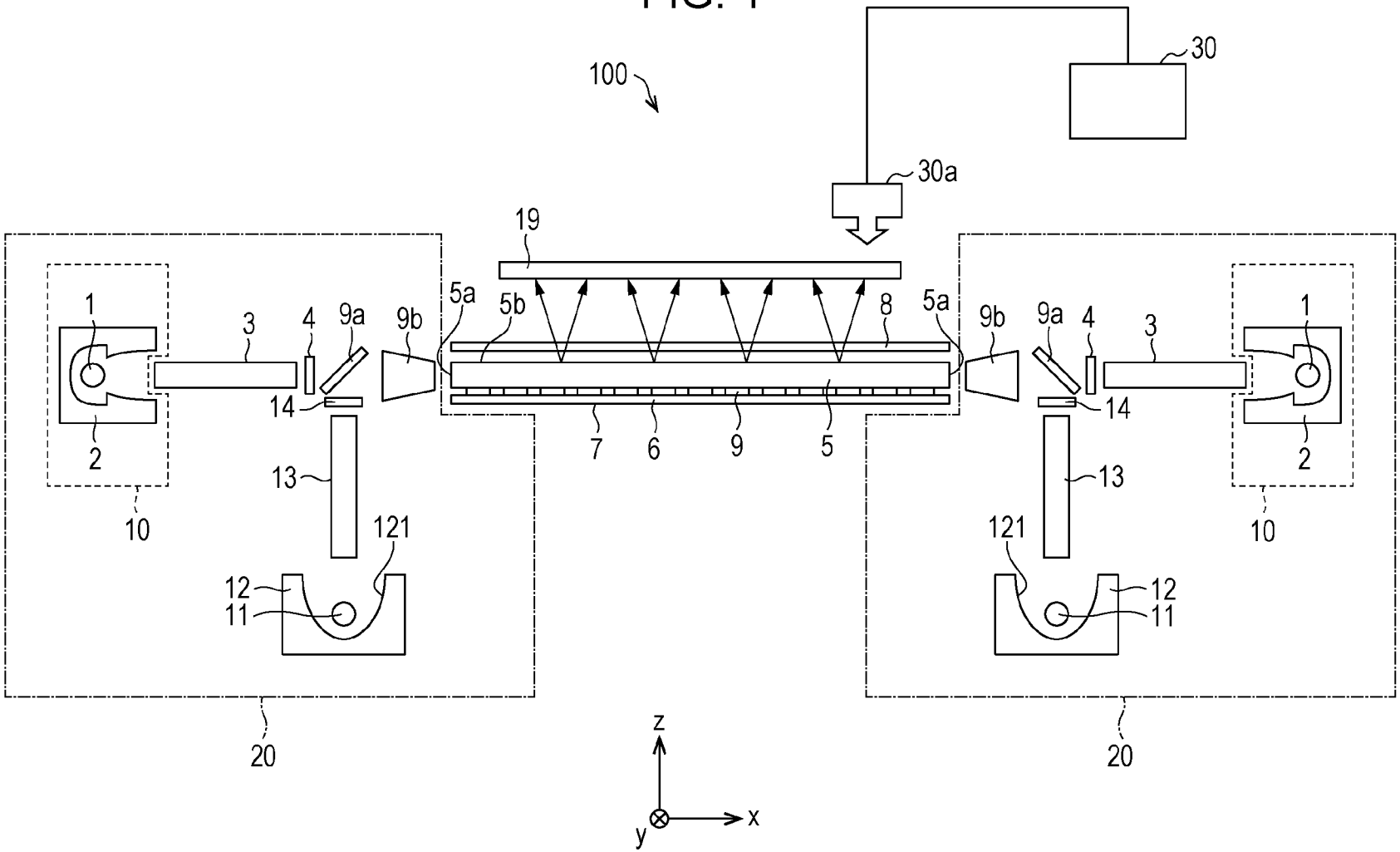
FIG. 1 schematically illustrates a relevant configuration of an artificial sunlight radiation apparatus according to a first embodiment of the present invention.

FIG. 1 schematically illustrates a relevant configuration of the artificial sunlight radiation apparatus 100. Artificial sunlight is a kind of artificial light and has an emission spectrum that is analogous to an emission spectrum of natural light (sunlight). The artificial sunlight radiation apparatus 100 according to this embodiment radiates combined light, which is obtained by combining halogen light and xenon light, as artificial sunlight onto the measured object 19, such as a solar battery.

As shown in FIG. 1, the artificial sunlight radiation apparatus 100 includes light radiating units 20 that radiate artificial sunlight, a light guide plate 5, light extracting means 6, reflecting means 7, and a protection plate 8. The light radiating units 20 radiate artificial sunlight toward ends 5*a* of the light guide plate 5. The artificial sunlight entering the light guide plate 5 through the ends 5*a* of the light guide plate 5 is radiated onto the measured object 19 from an upper surface 5*b* of the light guide plate 5. Thus, the artificial sunlight radiation apparatus 100 measures the properties of the measured object 19. When performing an actual measurement process, the measured object 19 is connected to a measurement terminal 30*a* of a measuring unit 30, and a detection signal is output to the measuring unit 30.

The artificial sunlight radiation apparatus 100 will be described in detail below. In the following description, the upper surface 5*b* side of the light guide plate 5 will be defined as an upper side, whereas the opposite side (underside) from the upper surface 5*b* will be defined as a lower side. Furthermore, the upper direction will be defined as a z direction, the direction extending from the left end toward the right end of the light guide plate 5 in FIG. 1 will be defined as an x direction, and the depth direction in FIG. 1 will be defined as a y direction.

(Light Radiating Units)

The light radiating units 20 are disposed at opposite side surfaces of the light guide plate 5. In the artificial sunlight radiation apparatus 100, two light radiating units 20 output artificial sunlight toward the opposite ends of the light guide plate 5. Therefore, a larger quantity of (brighter) artificial sunlight can be output from the upper surface 5*b*. However, the light radiating units 20 do not necessarily need to be provided at the opposite ends of the light guide plate 5, and may alternatively be provided at only one end of the light guide plate 5. The two light radiating units 20 have identical optical components.

Each light radiating unit 20 includes a first light source (light source) 1, a first condensing member (optical member) 2, a first light guide member 3, a first spectral adjustment member 4, a wavelength selecting member 9*a*, an optical coupling member 9*b*, a second light source 11, a second condensing member 12, a second light guide member 13, and a second spectral adjustment member 14. The first light source 1 and the first condensing member 2 are components that constitute a light source device 10 according to this embodiment.

(Light Sources)

In this embodiment, in order to make the spectrum of light radiated onto the measured object 19 analogous to that of actual sunlight, the first light source 1 and the second light source 11, which have different spectra, are used as the light sources. The first light source 1 is a halogen lamp, and the second light source 11 is a xenon lamp. A halogen lamp is a light source in which halogen gas (mainly, iodine, bromine, or the like is used) is inserted in addition to inert gas, such as nitrogen or argon, enclosed within a tube of a normal light source. A xenon lamp is a light source in which xenon is enclosed within a cylindrical arc tube.

In order to make light easily enter the ends 5*a* of the light guide plate 5, which is planar, each of the first light source 1 and the second light source 11 desirably has a structure with a horizontally-long tubular arc tube. For example, the first light source 1 has the shape of a tube extending in the depth direction in FIG. 1, and the longitudinal direction of the tube is aligned with a side surface of the light guide plate 5 extending in the y direction.

Figure 2:
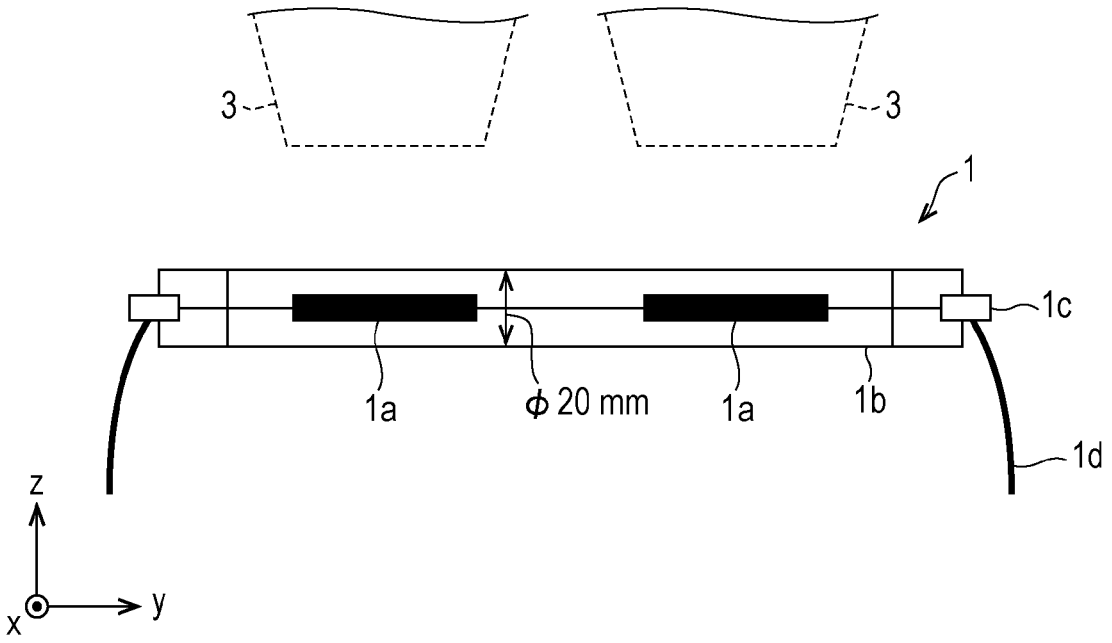
FIG. 2 schematically illustrates the configuration of a first light source in a light source device included in the artificial sunlight radiation apparatus.

FIG. 2 schematically illustrates the configuration of the first light source 1. The first light source 1 corresponds to an optical member according to the scope defined in the claims and includes two light-emitting sections 1*a*, an arc tube 1*b*, lead-wire connection sections 1*c*, and lead wires 1*d*. The light-emitting sections 1*a* are formed of filaments. The arc tube 1*b* has a narrow cylindrical shape. Opposite ends of the arc tube 1*b* are connected to the lead wires 1*d* via the lead-wire connection sections 1*c*. Inert gas and a small quantity of halogen gas are enclosed within the arc tube 1*b*. The two light-emitting sections 1*a* are connected in series between electrodes of the two lead-wire connection sections 1*c* at the opposite ends. The lead wires 1*d* connected to the lead-wire connection sections 1*c* are connected to a control circuit (not shown) including a light source. The above configuration facilitates, for example, the installation of the first light source 1 into the artificial sunlight radiation apparatus 100, the fetching and routing of the lead wires 1*d*, and the connection thereof to the control circuit.

The first light source 1 has a length of 215 mm, and the arc tube 1*b* thereof has a diameter $\phi$ of 20 mm. A dotted-line section denotes a set position of the first light guide member 3.

Due to having a tubular arc-tube structure, the first light source 1 outputs light in a 360-degree direction with respect to the y axis. Therefore, in order to condense the output light from the first light source 1 toward the light guide plate 5 as much as possible, the first light source 1 is disposed within the first condensing member 2 having an opening and a reflective section.

Figure 3:
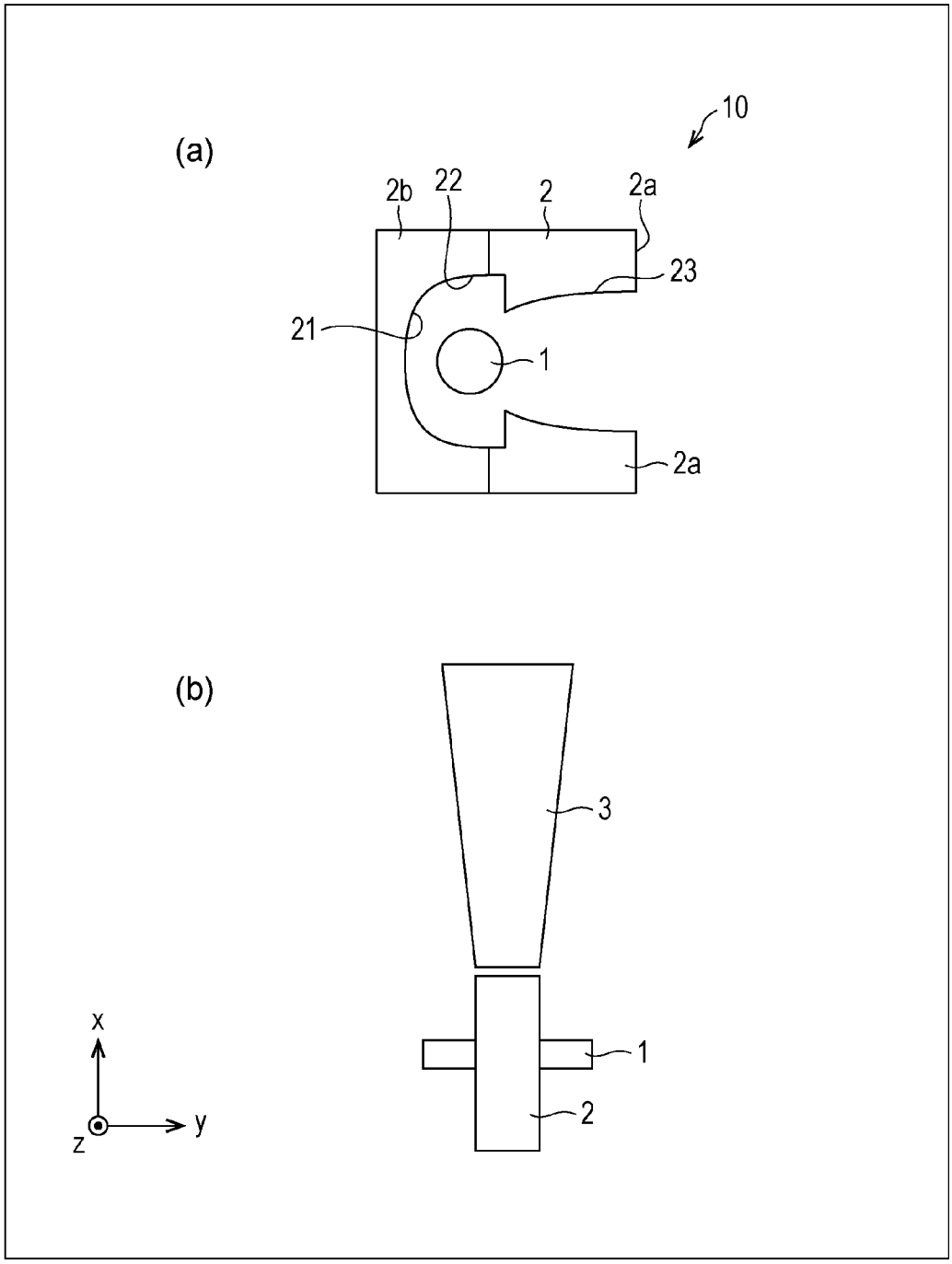
FIG. 3 includes an enlarged cross-sectional view (a) of a first condensing member in the light source device and a top view (b) of a light guide member and a surrounding area thereof in the artificial sunlight radiation apparatus.

FIG. 3(*a*) is an enlarged cross-sectional view of the first condensing member 2. The first condensing member 2 has a first opening 24 and accommodates the first light source 1, which is tubular, in the depth direction (y direction). In order to output the light from the first light source 1 efficiently through the first opening 24, a first elliptical reflective surface 21, a second elliptical reflective surface 22, and a third elliptical reflective surface 23 are formed within the first condensing member 2.

The first to third elliptical reflective surfaces 21 to 23 are reflective surfaces constituted of parts of three kinds of ellipses having different curvatures in cross section. The function of the first to third elliptical reflective surfaces 21 to 23 and the function of the first opening 24 will be described later with reference to FIG. 6.

Furthermore, as shown in FIG. 3(*a*), the first condensing member 2 includes a front condensing member 2*a* and a rear condensing member 2*b*. The front condensing member 2*a* includes the first opening 24 in the first condensing member 2 and corresponds to an output member according to the scope defined in the claims. The rear condensing member 2*b* does not include the first opening 24 in the first condensing member 2 and corresponds to a non-output member according to the scope defined in the claims.

Furthermore, the rear condensing member 2*b* is detachable from the first condensing member 2. Consequently, as will be described later, a maintenance process, such as a replacement process of the first light source 1, can be performed without having to disassemble the entire artificial sunlight radiation apparatus 100.

Similar to the first light source 1, the second light source 11 also has a structure with a tubular arc tube. The second light source 11 is disposed within the second condensing member 12 having an elliptical reflective surface 121. Light mainly output rearward (toward the lower side in the drawing) and in the horizontal direction from the second light source is reflected by the aforementioned elliptical reflective surface 121 and is output toward the upper side. Thus, the output light from the second light source 11 is condensed toward the light guide plate 5.

(Light Guide Members)

Each of the first light guide member 3 and the second light guide member 13 is an optical element that receives light through an entrance surface thereof, totally reflects the light at a wall surface thereof, guides the light to an opposing exit surface thereof, and outputs the light. As shown in FIG. 1, the entrance surface of the first light guide member 3 is disposed at the light guide plate 5 side (opening 24 side) of the first condensing member 2. Thus, the first light guide member 3 gives directivity to light output toward the light guide plate 5 from the first opening 24 of the first condensing member 2 before the light enters the light guide plate 5.

Furthermore, the second light guide member 13 is disposed above (light guide plate 5 side of) the second condensing member 12. Similar to the first light guide member 3, the second light guide member 13 gives directivity to output light from the second condensing member 12.

Accordingly, the output light from the first condensing member 2 is given directivity by passing through the first light guide member 3 and then enters the first spectral adjustment member 4. Likewise, the output light from the second condensing member 12 is given directivity by passing through the second light guide member 13 and then enters the second spectral adjustment member 14.

The first light guide member 3 will be further described with reference to FIG. 3(*b*). FIG. 3(*b*) is a top view of the first light guide member 3 and a surrounding area thereof, as viewed from the z direction in FIG. 1. As shown in this drawing, the first light guide member 3 has a pair of tapered surfaces facing each other in the y direction. Specifically, the cross-sectional area of the first light guide member 3 gradually increases from the entrance surface to the exit surface of the first light guide member 3. With this structure, the light entering the first light guide member 3 is repeatedly reflected by the side surfaces of the first light guide member 3, so that the directivity is improved (given thereto). Thus, light with aligned directivity in a direction (x direction) substantially vertical to the exit surface of the first light guide member 3 is output from the exit surface of the first light guide member 3.

The second light guide member 13 has a shape similar to that of the first light guide member 3. Thus, the directivity is improved for (given to) the light passing through the second light guide member 13 in accordance with a principle similar to that of the first light guide member 3.

(Spectral Adjustment Members)

Each of the first spectral adjustment member 4 and the second spectral adjustment member 14 is constituted of a filter obtained by forming a multilayer optical film over a glass substrate, and has a function of making the spectrum of light passing therethrough analogous to the spectrum distribution of reference sunlight. The first spectral adjustment member 4 is disposed facing the exit surface of the first light guide member 3. The second spectral adjustment member 14 is disposed facing the exit surface of the second light guide member 13.

Accordingly, the output light, which is given directivity by the first light guide member 3, from the first light source 1 enters the first spectral adjustment member 4, and the output light, which is given directivity by the second light guide member 13, from the second light source 11 enters the second spectral adjustment member 14.

(Wavelength Selecting Member)

The wavelength selecting member 9*a* is a plate-like member that reflects light with a wavelength shorter than a predetermined boundary wavelength and transmits light with a wavelength longer than the boundary wavelength. An entrance surface of the wavelength selecting member 9*a* is tilted at 45 degrees relative to the optical axis of the light passing through the first spectral adjustment member 4 and is also tilted at 45 degrees relative to the optical axis of the light passing through the second spectral adjustment member 14.

Figure 4:
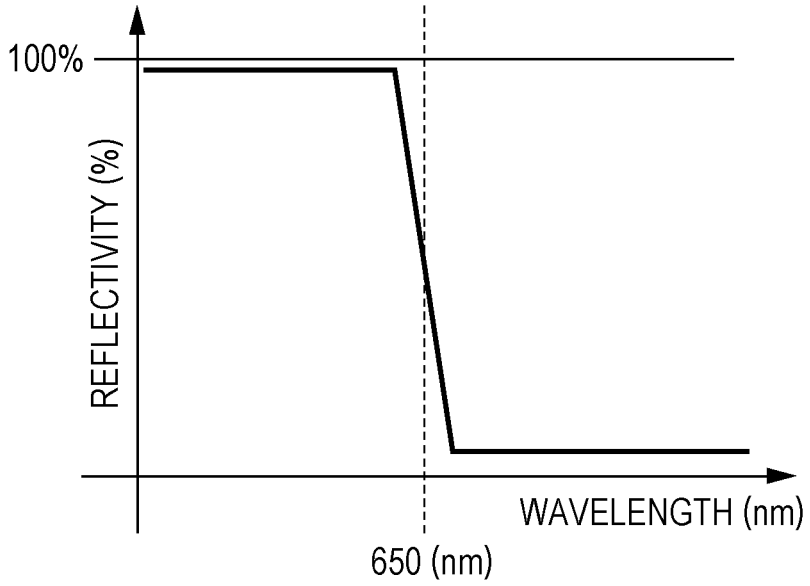
FIG. 4 illustrates the transmittance with respect to light entering a wavelength selecting member at an incident angle of 45 degrees.

FIG. 4 illustrates the transmittance with respect to the light entering the wavelength selecting member 9*a* at an incident angle of 45 degrees. As shown in FIG. 4, the wavelength selecting member 9*a* has a wavelength selecting function. Specifically, the wavelength selecting member 9*a* functions as a mixing member that selects (extracts) light beams necessary for artificial sunlight from the light output from the first light source 1, which is a halogen lamp, and the second light source 11, which is a xenon lamp, and that synthesizes artificial sunlight by mixing the selected light beams. In detail, the wavelength selecting member 9*a* reflects light with a wavelength shorter than a predetermined wavelength (at the short wavelength side of the predetermined wavelength (e.g., 650 nm in FIG. 4)) and transmits light with a wavelength longer than or equal to the predetermined wavelength (at the long wavelength side of the predetermined wavelength). In other words, the wavelength selecting member 9*a* has a function of transmitting light at the long wavelength side that is necessary for artificial sunlight and reflecting light at the short wavelength side. Then, the wavelength selecting member 9*a* mixes the light at the long wavelength side and the light at the short wavelength side so as to synthesize artificial sunlight.

More specifically, the output light from the first light source 1 contains a large quantity of long-wavelength-side component necessary for artificial sunlight. On the other hand, the output light from the second light source 11 contains a large quantity of short-wavelength-side component necessary for artificial sunlight. In the wavelength selecting member 9*a*, the boundary wavelength is set within a range of 600 nm to 800 nm, and the wavelength selecting member 9*a* reflects light with a wavelength shorter than this boundary wavelength and transmits light with a wavelength longer than or equal to the boundary wavelength. In other words, of the output light from the first light source 1, only a light beam (long-wavelength-side light component) with a wavelength longer than or equal to the boundary wavelength is transmitted by the wavelength selecting member 9*a* and enters the optical coupling member 9*b*. On the other hand, of the output light from the second light source 11, only a light beam (short-wavelength-side light component) with a wavelength shorter than the boundary wavelength is reflected by the wavelength selecting member 9*a* and enters the optical coupling member 9*b*.

Accordingly, the light beam from the first light source 1 and the light beam from the second light source 11 respectively pass through the first spectral adjustment member 4 and the second spectral adjustment member 14, and the light beams passing therethrough further pass through (are transmitted or reflected by) the wavelength selecting member 9*a* so that artificial sunlight is generated.

(Optical Coupling Member)

The optical coupling member 9*b* is an optical element that receives light through an entrance surface thereof, totally reflects the light at a wall surface thereof, guides the light to an opposing exit surface thereof, and outputs the light. The entrance surface of the optical coupling member 9*b* is disposed adjacent to the wavelength selecting member 9*a*. The optical coupling member 9*b* has a pair of tapered surfaces facing each other in the z direction. Specifically, the cross-sectional area of the optical coupling member 9*b* gradually decreases from the entrance surface to the exit surface of the optical coupling member 9*b*. Thus, the light entering the optical coupling member 9*b* from the wavelength selecting member 9*a* spreads in the z direction and is output from the exit surface whose width in the z direction is smaller than that of the entrance surface. The light output from the exit surface of the optical coupling member 9*b* enters the corresponding end 5*a* of the light guide plate 5.

Accordingly, the width, in the z direction, of the light passing through the optical coupling member 9*b* can be made smaller than the width, in the z direction, of the light prior to entering the optical coupling member 9*b*, whereby the light guide plate 5 can be made thinner. Since the light guide plate 5 requires a large area, the cost of the light guide plate 5 can be significantly reduced.

(Light Guide Plate)

The light guide plate 5 is provided between the two light radiating units 20 disposed facing each other. The two light radiating units 20 disposed at the opposite sides of the light guide plate 5 radiate artificial sunlight onto the opposite side surfaces thereof. The light guide plate 5 radiates the artificial sunlight from the upper surface 5*b* of the light guide plate 5. In order to increase the transmittance, the light guide plate 5 is preferably composed of, for example, quartz glass.

The light extracting means 6 is formed at the lower surface (undersurface) of the light guide plate 5. The light extracting means 6 extracts the artificial sunlight output from the light radiating units 20 to the upper surface 5*b* of the light guide plate 5. In detail, the artificial sunlight entering the light guide plate 5 from the light radiating units 20 propagates through the light guide plate 5 while repeatedly undergoing total internal reflection therein. In this case, the light hitting the light extracting means 6 is output toward the upper surface 5*b* of the light guide plate 5. Thus, the artificial sunlight can be radiated uniformly from a wider area of the radiation surface.

The light extracting means 6 may be formed of, for example, a scattering member. The scattering member can scatter the artificial sunlight within the light guide plate 5 and guide the artificial sunlight toward the upper surface 5*b*. Furthermore, by changing the pattern of the scattering member, an illuminance variation of the artificial sunlight can be adjusted. For example, a pattern of dots may be formed on the light extracting means 6 by printing or molding.

The reflecting means 7 reflects light leaking downward from the light guide plate 5 or the light extracting means 6 toward the upper surface 5*b* of the light guide plate 5. The reflecting means 7 may be, for example, a reflective mirror composed of aluminum.

The protection plate 8 is appropriately installed for protecting the light guide plate 5 from, for example, dust or scattered pieces of glass created from accidental breakage of the measured object 19.

(Example of Artificial Sunlight Radiation Apparatus)

An example of the artificial sunlight radiation apparatus 100 described with reference to FIGS. 1 to 3 will be described below.

Figure 5:
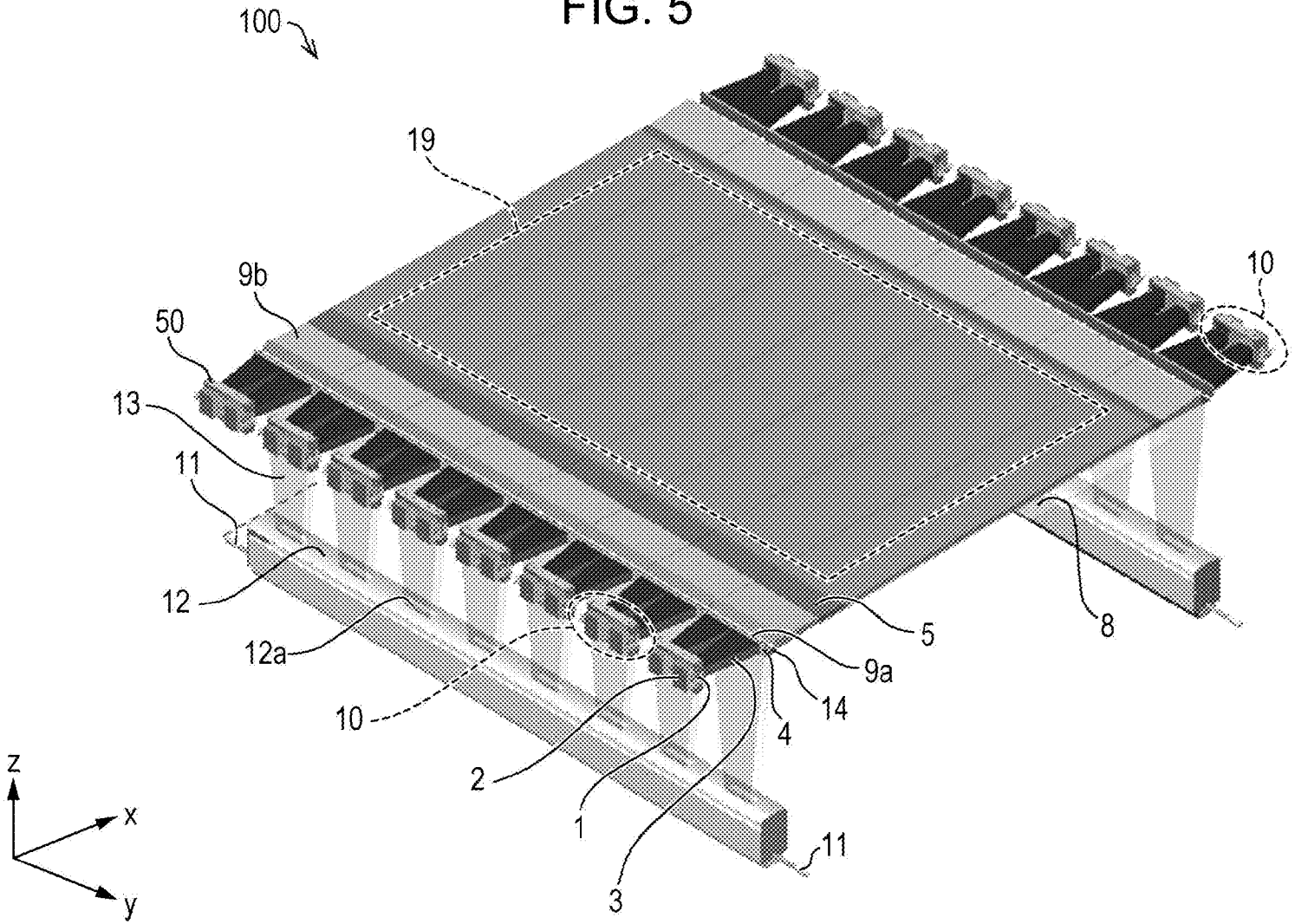
FIG. 5 is a perspective view illustrating the configuration of the artificial sunlight radiation apparatus.

FIG. 5 is a perspective view illustrating the configuration of the artificial sunlight radiation apparatus 100. In order to provide an easier understanding of the relationship between components, some components are shown in a semitransparent state in FIG. 5, and an external housing, a supporter, and so on have been omitted therefrom.

In FIG. 5, a position where a measured object 19 serving as a solar battery is disposed is denoted by a dotted line. An irradiated area of the measured object 19 that can be placed is about 1400 mm by 1000 mm at maximum. The measured object 19 is disposed above the protection plate 8.

In the artificial sunlight radiation apparatus 100, a first light source 1, which is a halogen lamp, is installed at the entrance end of each first light guide member 3. With regard to the first light guide members 3, sixteen of them are arranged in the y direction, such that the first light guide members 3 and the light-emitting sections 1*a* of the first light sources have a one-to-one relationship.

Each first light source 1 and each first condensing member 2 that constitute a light source device 10 are supported by a frame 50. The frame 50 is a structural member that allows the first light sources 1 and the first condensing members 2 to be easily attached to the artificial sunlight radiation apparatus 100. More specifically, a single first light source 1 having two light-emitting sections 1*a* and a single first condensing member 2 are attached to the frame 50 so as to constitute a light source device 10. Moreover, each light source device 10 is attached to the artificial sunlight radiation apparatus 100 so as to correspond to two first light guide members 3.

At the lower section of the artificial sunlight radiation apparatus 100, a second light source 11, which is a xenon lamp, is covered by a second condensing member 12. Light from the second light source 11 is output through a second opening 12*a* provided in the second condensing member 12 and enters a second light guide member 13.

The light entering the first light guide members 3 from the first light sources 1 and the light entering the second light guide member 13 from the second light source 11 are spectrally adjusted by the first spectral adjustment member 4 and the second spectral adjustment member 14, respectively, and then reach the wavelength selecting member 9*a*. In the wavelength selecting member 9*a*, wavelengths in regions described above with reference to FIG. 4 are selected by transmission or reflection, and the selected light beams travel toward the light guide plate 5. Light that has become artificial sunlight prior to entering the light guide plate 5 is deflected in the z direction by, for example, the light extracting means 6 and the reflecting means 7 (not shown) after entering the light guide plate 5, and is then radiated onto the measured object 19.

(Light Source Device)

Next, each light source device 10 will be described in further detail with reference to FIGS. 6 to 8.

Figure 6:
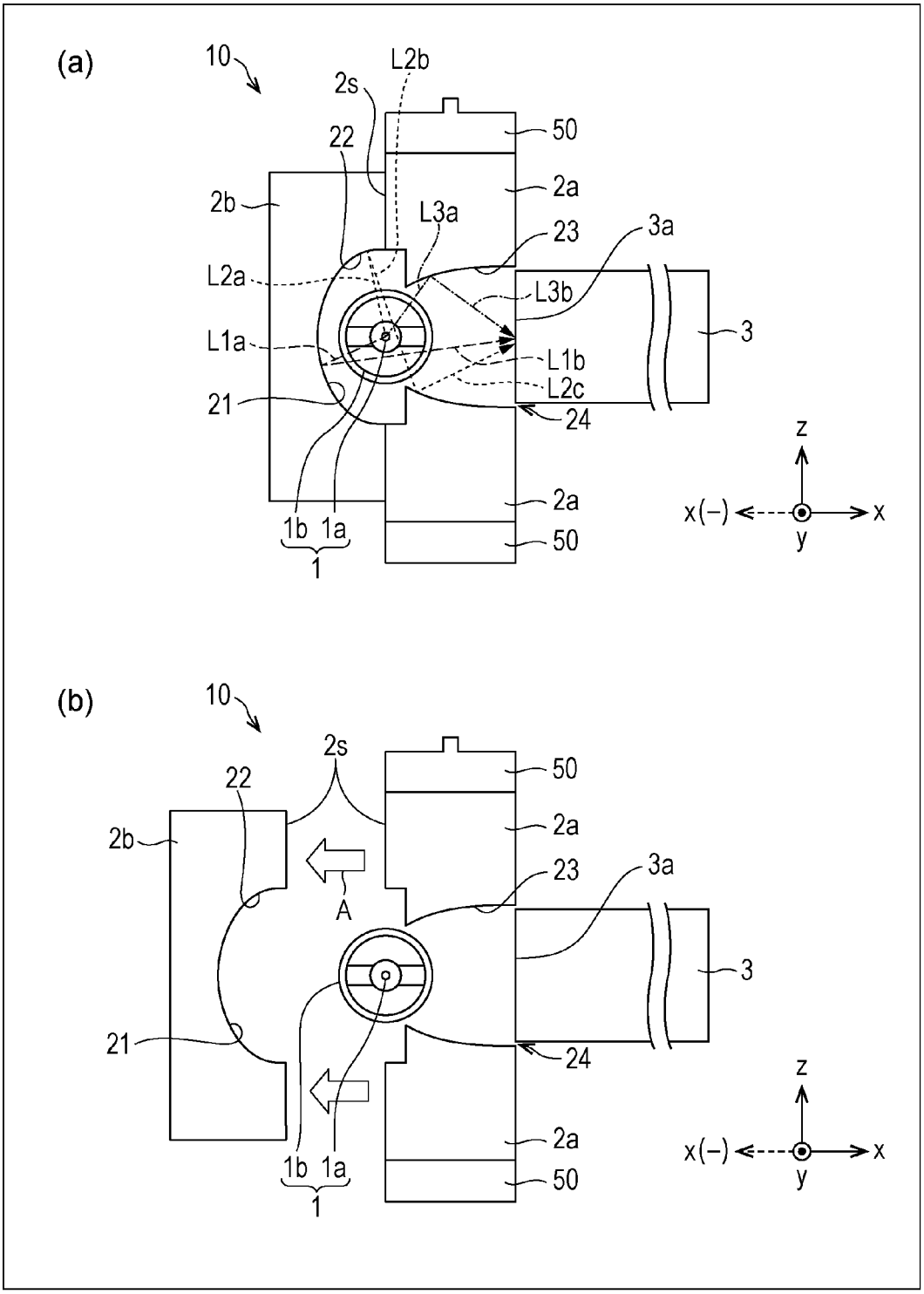
FIG. 6 includes cross-sectional views (a) and (b) of the light source device in the artificial sunlight radiation apparatus, the cross-sectional view (a) illustrating a state where a rear condensing member is not removed and the cross-sectional view (b) illustrating a state where the rear condensing member has been removed.

FIG. 6(*a*) is a cross-sectional view illustrating the configuration of each light source device 10. The light source device 10 includes the first light source 1 and the first condensing member 2 in which the first light source 1 is disposed. The first light source 1 and the first condensing member 2 are attached to the frame 50. The first condensing member 2 includes the front condensing member 2*a* and the rear condensing member 2*b*. The front condensing member 2*a* and the rear condensing member 2*b* are in contact with each other at a contact surface 2*s*. Furthermore, the center of the first light source 1, that is, the center of each light-emitting section 1*a*, is disposed in a plane that includes the contact surface 2*s*.

The components constituting the first condensing member 2 will be described in further detail. The first condensing member 2 has a structure that accommodates the first light source 1, which is tubular, in the depth direction (y direction). In order to output the light from the first light source 1 efficiently through the first opening 24, the first to third elliptical reflective surfaces 21 to 23 are formed within the first condensing member 2. The first to third elliptical reflective surfaces 21 to 23 are reflective surfaces constituted of parts of three kinds of ellipses having different curvatures in cross section.

The first elliptical reflective surface 21 has a main function of reflecting light L1*a* output rearward from the first light source 1 (i.e., toward the opposite side from the first light guide member 3) so as to deflect the light toward the first opening 24. Light L1*b* deflected toward the first opening 24 is condensed to a central area of an end surface 3*a* of the first light guide member 3 disposed at the position of the first opening 24 and enters the first light guide member 3.

The second elliptical reflective surface 22 has a main function of reflecting light L2*a* output slightly rearward toward the z-direction side from the first light source 1 so as to deflect the light toward the third elliptical reflective surface 23. Light L2*b* deflected toward the third elliptical reflective surface 23 is further reflected by the third elliptical reflective surface 23 so as to be deflected toward the first opening 24. Light L2*c* deflected toward the first opening 24 is condensed to the central area of the end surface 3*a* of the first light guide member 3 disposed at the position of the first opening 24 and enters the first light guide member 3.

The third elliptical reflective surface 23 has a main function of reflecting light L3*a*, which is output from the first light source 1 in a direction in which the light does not directly enter the first opening 24 located in front thereof, so as to deflect the light toward the first opening 24. Light L3*b* deflected toward the first opening 24 is condensed to the central area of the end surface 3*a* of the first light guide member 3 disposed at the position of the first opening 24 and enters the first light guide member 3.

The first to third elliptical reflective surfaces 21 to 23 are each formed by processing a surface of a structural object composed of, for example, metal into a desired elliptical shape and then forming a highly-reflective thin metal film over the aforementioned surface by, for example, deposition. Although the thin metal film may be formed by a general aluminum deposition technique, each of the first to third elliptical reflective surfaces 21 to 23 in this embodiment is surface-treated by a gold (Au) deposition technique.

Due to having a complex cross-sectional shape, it is difficult to manufacture each of the first to third elliptical reflective surfaces 21 to 23 by, for example, performing digging processing on the structural object composed of, for example, metal through the first opening 24.

Furthermore, when detaching the first light source 1, it is difficult to approach through the first opening 24 located at the side where the first light guide member 3 and the like exist.

Due to the above reasons, in this embodiment, the first condensing member 2 has a composite configuration constituted of multiple dividable components. In detail, the first condensing member 2 is divided, at the contact surface 2*s*, into the front condensing member 2*a* that includes the first opening 24 and the rear condensing member 2*b* that does not include the first opening 24, such that the rear condensing member 2*b* is detachable from the first condensing member 2.

Accordingly, when performing a replacement process of the first light source 1, the rear condensing member 2*b* is removed from the first condensing member 2 (first removal step). Subsequently, the first light source 1 is removed through the area where the rear condensing member 2*b* is removed from the first condensing member 2 (second removal step). Specifically, in a method for maintaining the light source device 10 according to this embodiment, the first light source 1 can be removed through an area other than the first opening 24, so that the artificial sunlight radiation apparatus 100 does not need to be disassembled.

FIG. 6(*b*) is a cross-sectional view illustrating the configuration of the light source device 10 in a state where the rear condensing member 2*b* has been removed from the first condensing member 2. As shown in FIG. 6(*b*), the rear condensing member 2*b* can be detached in an x (−) direction (direction indicated by an arrow A) from the front condensing member 2*a* that includes the first opening 24.

Accordingly, by removing the rear condensing member 2*b* from the first condensing member 2, the first light source 1 can be easily removed toward the left side in FIG. 6(*b*). Thus, a maintenance process, such as a replacement process of the first light source 1, can be performed without having to disassemble the entire artificial sunlight radiation apparatus 100. Moreover, even after the first light source 1 has been replaced, for example, a mechanical displacement of the optical system, such as the elliptical reflective surfaces, within the first condensing member 2 and an optical deviation caused by such a mechanical displacement can be prevented.

Furthermore, since the front condensing member 2*a* and the rear condensing member 2*b* are attached to each other by bringing them into contact with each other at the contact surface 2*s*, which is flat, the first condensing member 2 can be easily manufactured.

Moreover, the center of the first light source 1, that is, the center of each light-emitting section 1*a*, is disposed in the plane that includes the contact surface 2*s*. In this case, when the rear condensing member 2*b* has been removed, since the distance between the first light source 1 and an area on the inner surface of the front condensing member 2*a* that is the closest to the first light source 1 is relatively large, the first light source 1 can be removed even more easily.

Furthermore, the front condensing member 2*a* has the third elliptical reflective surface 23 and a part of the second elliptical reflective surface 22 formed therein, and the rear condensing member 2*b* has a part of the second elliptical reflective surface 22 and the first elliptical reflective surface 21 formed therein. Accordingly, since the elliptical reflective surfaces are formed in the front condensing member 2*a* and the rear condensing member 2*b*, and the front condensing member 2*a* and the rear condensing member 2*b* are combined with each other, a first condensing member 2 with a complex internal shape can be easily manufactured. Moreover, by depositing metal, such as Au, over each of the front condensing member 2*a* and the rear condensing member 2*b*, a metal deposition process can be easily performed.

Next, the light source device 10 will be described with reference to perspective views.

Figure 7:
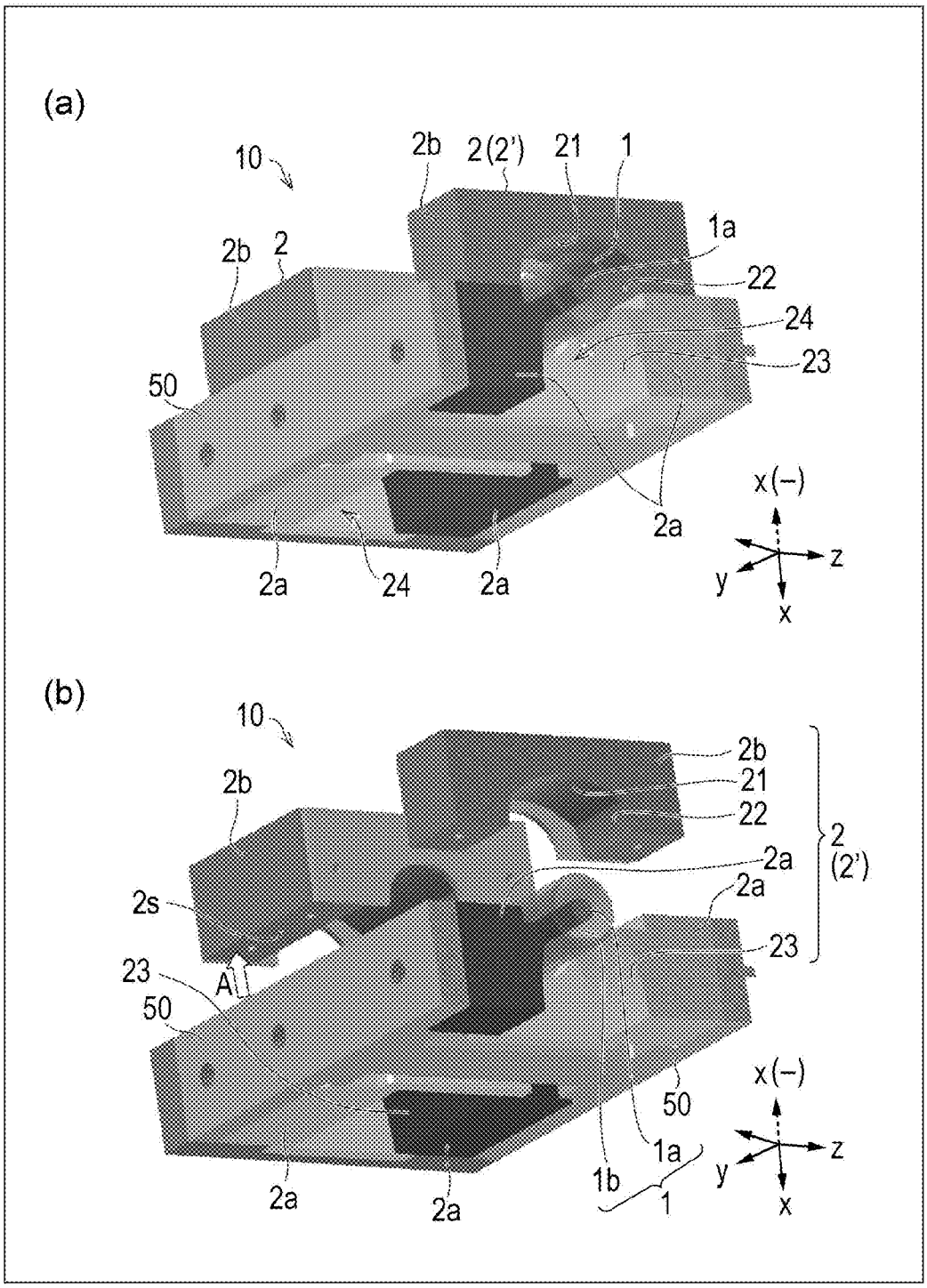
FIG. 7 includes perspective views (a) and (b) of the light source device shown in FIG. 6, the perspective view (a) illustrating a state where the rear condensing member is not removed and the perspective view (b) illustrating a state where the rear condensing member has been removed.

FIG. 7(*a*) is a perspective view illustrating the configuration of the light source device 10 in a state where the rear condensing member 2*b* is not removed from the first condensing member 2. FIG. 7(*b*) is a perspective view illustrating the configuration of the light source device 10 in a state where the rear condensing member 2*b* has been removed from the first condensing member 2. In FIGS. 7(*a*) and 7(*b*), the first opening 24 of the first condensing member 2 faces downward. A first condensing member 2' in the front is shown in a cutaway state so as to illustrate its internal configuration.

As shown in FIG. 7(*a*), of the components constituting the first condensing member 2, only the front condensing member 2*a* is fixed to the frame 50. On the other hand, since the rear condensing member 2*b* is not fixed to the frame 50, the rear condensing member 2*b* is easily removable from the first condensing member 2, as shown in FIG. 7(*b*).

Figure 8:
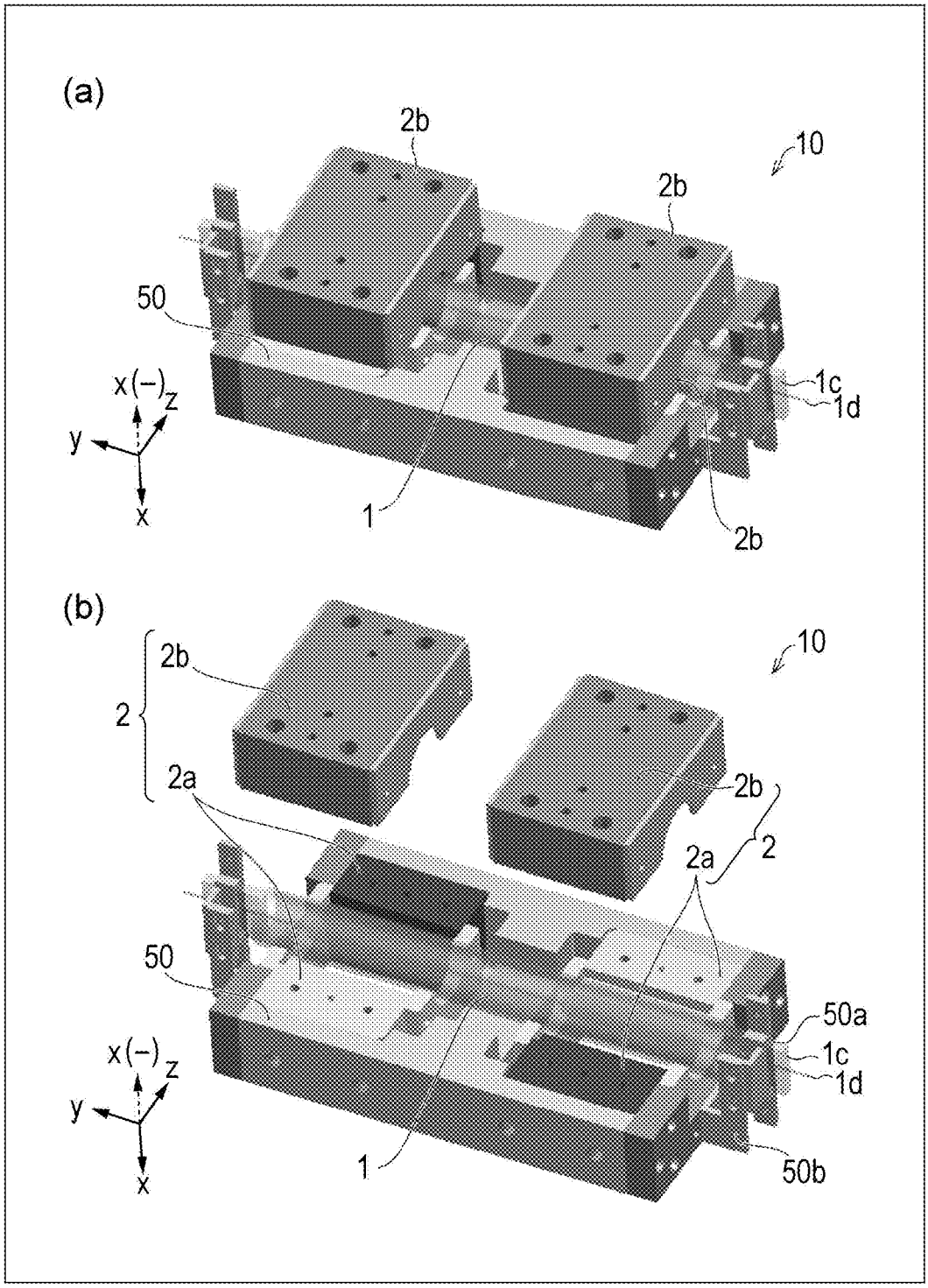
FIG. 8 includes perspective views (a) and (b) of the light source device shown in FIG. 7, as viewed from a different angle, the perspective view (a) illustrating a state where the rear condensing member is not removed and the perspective view (b) illustrating a state where the rear condensing member has been removed.

FIG. 8 includes perspective views of the light source device 10, as viewed from an angle different from that in FIG. 7 (from the opposite side of the first light guide member 3, that is, the outer side of the artificial sunlight radiation apparatus 100). FIG. 8(*a*) illustrates a state where the rear condensing member 2*b* is not removed from the first condensing member 2, and FIG. 8(*b*) illustrates a state where the rear condensing member 2*b* has been removed from the first condensing member 2.

As described above, the first light source 1 includes two light-emitting sections 1*a* that are connected in series, and one first condensing member 2 is disposed in correspondence with one light-emitting section 1*a*. The frame 50 has lamp attachment sections 50*b* in correspondence with opposite sides of the first light source 1. The lamp attachment sections 50*b* have grooves 50*a* into which the lead-wire connection sections 1*c* of the first light source 1 are slidably fitted.

In the state shown in FIG. 8(*b*), the first light source 1 is pulled in the x (−) direction so that the first light source 1 can be easily removed from the lamp attachment sections 50*b*.

Second Embodiment

Another embodiment of a light source device according to the present invention will be described below with reference to FIG. 9. For the sake of convenience, components having functions similar to those of the components described in the first embodiment are given the same reference characters, and descriptions thereof will be omitted.

Figure 9:
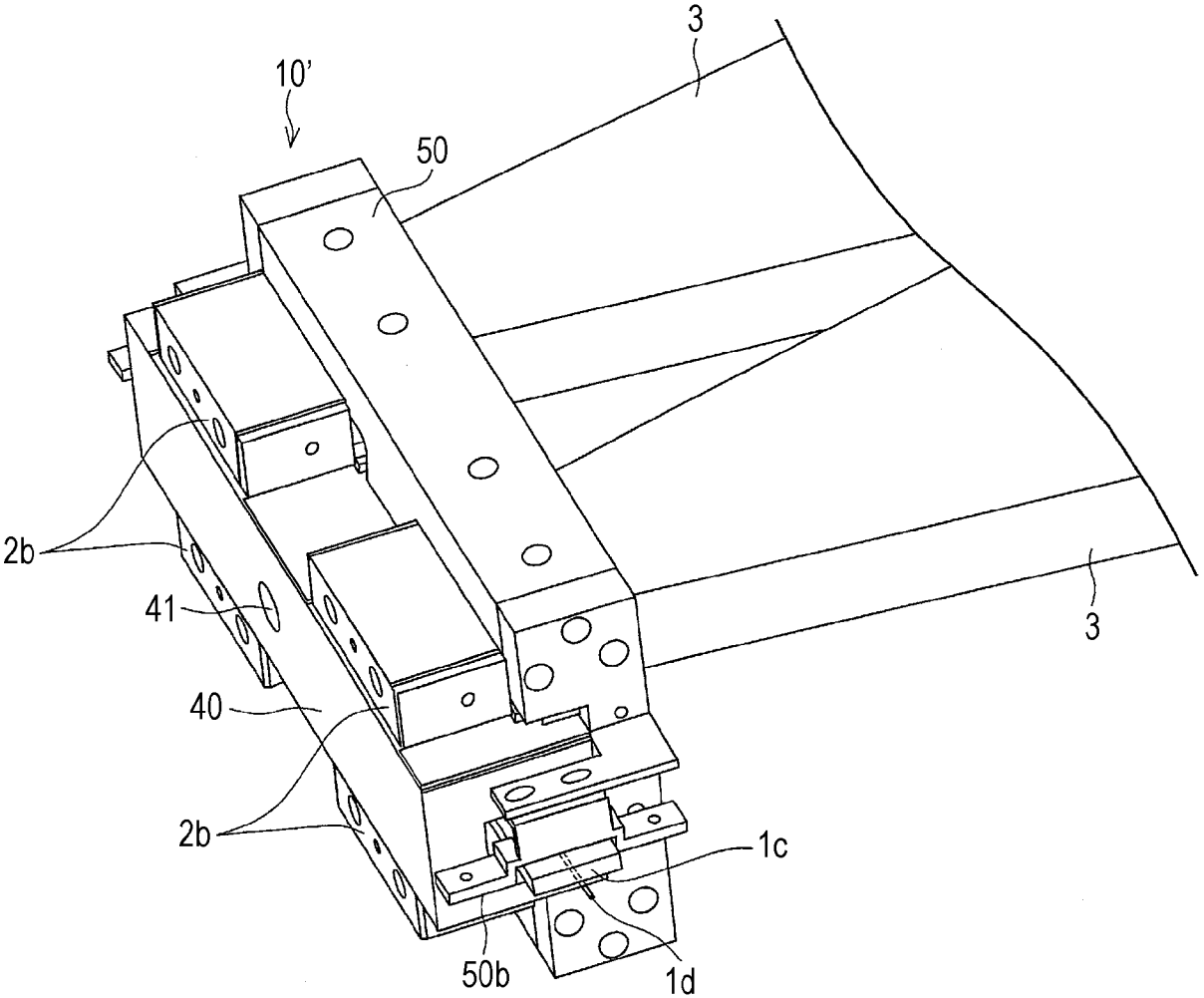
FIG. 9 is a perspective view illustrating the configuration of a light source device according to a second embodiment of the present invention.

FIG. 9 is a perspective view illustrating the configuration of a light source device 10' according to this embodiment. The light source device 10' has a configuration in which the rear side (opposite side from the first light guide member 3) of the first condensing member 2 is covered with a lamp cover 40 in the light source device 10 according to the first embodiment. The lamp cover 40 protects a large portion (large portion excluding areas near the lead-wire connection sections 1*c*) of the first light source 1.

When emitting light, the first light source 1, which is a halogen lamp, is in an extremely high temperature state. When the first light source 1 is emitting light in a proper halogen cycle, the inner surface of the arc tube 1*b* reaches a high temperature of about 250° C. Therefore, by installing the lamp cover 40, safety can be ensured during, for example, a replacement process of the first light source 1.

Furthermore, by installing the lamp cover 40, even when, for example, the first light source 1 accidentally breaks, glass used for forming the arc tube 1*b* as well as other components such as the light-emitting sections 1*a* can be prevented from scattering.

Moreover, an observation hole (hole) 41 is provided at the center of the lamp cover 40. In other words, the observation hole 41 is located behind the center of the first light source 1 between two first condensing members 2.

Consequently, even when the lamp cover 40 is attached, an operator can observe the light-emitting state of the first light source 1. Thus, when, for example, a light emission defect occurs, the operator can take appropriate measures, such as stopping the operation and switching to a maintenance process.

When performing a maintenance process, such as a replacement process of the first light source 1, the lamp cover 40 is first removed so that the state shown in FIG. 8(*a*) is obtained. Subsequently, the rear condensing member 2*b* is removed from the first condensing member 2 in accordance with the procedure described in the first embodiment. Then, the first light source 1 is removed, whereby the maintenance process can be easily executed.

The position of the observation hole 41 is not limited to the center of the lamp cover 40. The observation hole 41 may be located at any position where the operator can observe the light-emitting state of the first light source 1.

Outline of Embodiments

In each embodiment described above, the first condensing member is constituted of two sections, namely, the front condensing member and the rear condensing member. Therefore, by detaching the rear condensing member, a maintenance process, such as a replacement process of the first light source, can be easily performed without having to disassemble the entire artificial sunlight radiation apparatus.

Furthermore, by providing the lamp cover, safety measures against, for example, a temperature increase in the first light source and accidental breakage thereof can be sufficiently taken.

Furthermore, since the lamp cover is provided with the observation hole, safety measures against, for example, a temperature increase in the lamp and accidental breakage thereof can be taken while allowing for observation of the light-emitting state during operation.

In each of the above embodiments, the first condensing member is constituted of two members, namely, the front condensing member and the rear condensing member. Alternatively, the first condensing member may be constituted of three or more members. For example, the rear condensing member may be constituted of multiple components, such that at least one of the components of the rear condensing member may be detachable from the first condensing member. Even with such a configuration, the first light source can be removed through an area where the at least one component is removed from the first condensing member, that is, an area other than the opening, whereby a maintenance process can be easily performed.

The present invention is not limited to the above-described embodiments, and various modifications are permissible within the scope defined in the claims. Specifically, an embodiment obtained by appropriately combining technical means disclosed in different embodiments is also included in the technical scope of the invention.

General Outline

Accordingly, in a light source device according to an embodiment of the present invention, the optical member preferably has therein a reflective surface that is elliptical in cross section.

According to the above configuration, an output member and a non-output member that constitute the optical member each have an elliptical reflective surface. By combining these members, an optical member with a complex internal shape can be easily manufactured.

In the light source device according to the embodiment of the present invention, the at least one component preferably has a contact surface and is preferably attached to the optical member via the contact surface.

According to the above configuration, the at least one component is attached to the optical member by bringing the contact surface into contact therewith, whereby the optical member can be easily manufactured.

In the light source device according to the embodiment of the present invention, the center of the light source is preferably disposed in a plane that includes the contact surface of the at least one component.

According to the above configuration, in a state where the at least one component is removed, since the distance between the light source and an area on the inner surface of a remaining part of the optical member that is the closest to the light source is relatively large, the light source can be removed even more easily.

In the light source device according to the embodiment of the present invention, the non-output member may be constituted of a single component.

It is preferable that the light source device according to the embodiment of the present invention further include a cover that protects the light source.

According to the above configuration, safety can be ensured during, for example, a replacement process of the light source.

In the light source device according to the embodiment of the present invention, the cover preferably has a hole used for observing a light-emitting state of the light source.

According to the above configuration, an operator can observe the light-emitting state of the light source so that when, for example, a light emission defect occurs, the operator can take appropriate measures, such as stopping the operation and switching to a maintenance process.

In an artificial sunlight radiation apparatus according to an embodiment of the present invention, it is preferable that the light source device further include attaching means for attaching the light source device to the artificial sunlight radiation apparatus.

According to the above configuration, the light source device can be easily attached to the artificial sunlight radiation apparatus by using the attaching means.

INDUSTRIAL APPLICABILITY

The present invention can be used in an artificial sunlight radiation apparatus.

REFERENCE SIGNS LIST

1 first light source (light source)
1*a* light-emitting section
1*b* arc tube
1*c* lead-wire connection section
1*d* lead wire
2, 2' first condensing member (optical member)
2*a* front condensing member (output member)
2*b* rear condensing member (non-output member)
2*s* contact surface
3 first light guide member
3*a* end surface
4 first spectral adjustment member
5 light guide plate
5*a* end
5*b* upper surface
6 light extracting means
7 reflecting means
8 protection plate
9*a* wavelength selecting member
9*b* optical coupling member
10, 10' light source device
11 second light source
12 second condensing member
12*a* second opening
13 second light guide member
14 second spectral adjustment member
19 measured object
20 light radiating unit
21 first elliptical reflective surface
22 second elliptical reflective surface
23 third elliptical reflective surface
24 first opening (opening)
30 measuring unit
30*a* measurement terminal
40 lamp cover (cover)
41 observation hole (hole)
50 frame (attaching means)
50*a* groove
50*b* lamp attachment section
100 artificial sunlight radiation apparatus
121 elliptical reflective surface

The invention claimed is:

1. An artificial sunlight radiation apparatus comprising:
a light source device;
a light guide member that receives light output from the light source device;
a spectral adjustment member that adjusts a spectrum of light output from the light guide member and outputs artificial sunlight; and
a light guide plate that radiates the artificial sunlight output from the spectral adjustment member onto a measured object,
wherein the light source device includes:
a light source; and
an optical member that has an opening, has the light source disposed therein, and outputs output light from the light source through the opening,
wherein the optical member includes an output member that includes the opening and a non-output member that does not include the opening, and
wherein at least one component of the non-output member is detachable from the optical member.

2. The artificial sunlight radiation apparatus according to claim 1, wherein the light source device further includes attaching means for attaching the light source device to the artificial sunlight radiation apparatus.

* * * * *